US011218805B2

(12) United States Patent
Curtis et al.

(10) Patent No.: US 11,218,805 B2
(45) Date of Patent: Jan. 4, 2022

(54) MANAGING LOW FREQUENCIES OF AN OUTPUT SIGNAL

(71) Applicant: Roku, Inc., Los Gatos, CA (US)

(72) Inventors: Robert Caston Curtis, Los Gatos, CA (US); Kasper Andersen, Aarhus N. (DK)

(73) Assignee: Roku, Inc., San Jose, CA (US)

( * ) Notice: Subject to any disclaimer, the term of this patent is extended or adjusted under 35 U.S.C. 154(b) by 0 days.

(21) Appl. No.: 16/671,991

(22) Filed: Nov. 1, 2019

(65) Prior Publication Data

US 2021/0136494 A1 May 6, 2021

(51) Int. Cl.
*H04R 3/04* (2006.01)

(52) U.S. Cl.
CPC ..... *H04R 3/04* (2013.01); *G10H 2210/066* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,873,306 | B2 | 12/2020 | Hwang et al. | |
| 2004/0033056 | A1 | 2/2004 | Montag et al. | |
| 2005/0058303 | A1 | 3/2005 | Martin et al. | |
| 2007/0160232 | A1* | 7/2007 | Jenkins | G11B 20/10009 381/102 |
| 2009/0147963 | A1* | 6/2009 | Smith | H04R 3/04 381/62 |
| 2009/0220098 | A1 | 9/2009 | Christoph | |
| 2013/0077795 | A1* | 3/2013 | Risbo | H04R 29/003 381/55 |
| 2015/0146890 | A1* | 5/2015 | Yang | H04S 7/307 381/119 |
| 2016/0373858 | A1* | 12/2016 | Lawrence | H04R 3/04 |
| 2017/0325024 | A1* | 11/2017 | Hu | H04R 29/001 |
| 2018/0014121 | A1* | 1/2018 | Lawrence | G10L 21/0272 |

FOREIGN PATENT DOCUMENTS

| | | |
|---|---|---|
| EP | 0823189 | 8/2004 |
| KR | 10-2018-0087782 | 8/2018 |

* cited by examiner

*Primary Examiner* — Duc Nguyen
*Assistant Examiner* — Assad Mohammed
(74) *Attorney, Agent, or Firm* — Sterne, Kessler, Goldstein & Fox P.L.L.C.

(57) ABSTRACT

Embodiments included herein generally relate to managing low frequencies of an output signal. For example, a method may include: measuring a sound pressure level (SPL) of a speaker; dynamically selecting a cutoff frequency for operating a first filter configured to provide a first bass component of a bass element of an output signal and a second filter configured to provide a second bass component of the bass element; providing the cutoff frequency to the first filter to configure the first filter to generate the first bass component based on the cutoff frequency; providing the cutoff frequency to the second filter to configure the second filter to generate the second bass component based on the cutoff frequency; and generating an output signal based on at least one of the first and second bass components.

20 Claims, 5 Drawing Sheets

MANAGING LOW FREQUENCIES OF AN OUTPUT SIGNAL

TECHNICAL FIELD

Embodiments included herein generally relate to managing low frequencies of an output signal.

BACKGROUND

Speakers may be designed to provide a more extended, linear, and dynamic bass response, which is a significant challenge in designing speakers. With an increasing amount of low frequency content in media content, consumers frequently desire a speaker that recreates the experience of a significant amount of bass, such as that experienced at a concert or movie theater, on their personal electronic devices. In many situations, constraints on size and budget may cause a designer to compromise on a speaker's bass performance, which may impair the speakers ability to provide, for example, the concert/theater experience. To resolve this issue, small electronic devices may be designed using psychoacoustics. One application of psychoacoustics is in the design of small or lower-quality speakers, e.g., for use in mobile devices, laptops, etc., which may use the phenomenon of missing fundamentals to give the effect of bass notes at lower frequencies than the loudspeakers are physically able to produce.

BRIEF DESCRIPTION OF THE DRAWINGS

The accompanying drawings are incorporated herein and form a part of the specification.

In the drawings, like reference numbers generally indicate identical or similar elements. Additionally, generally, the left-most digit(s) of a reference number identifies the drawing in which the reference number first appears.

SUMMARY

Figure 1:
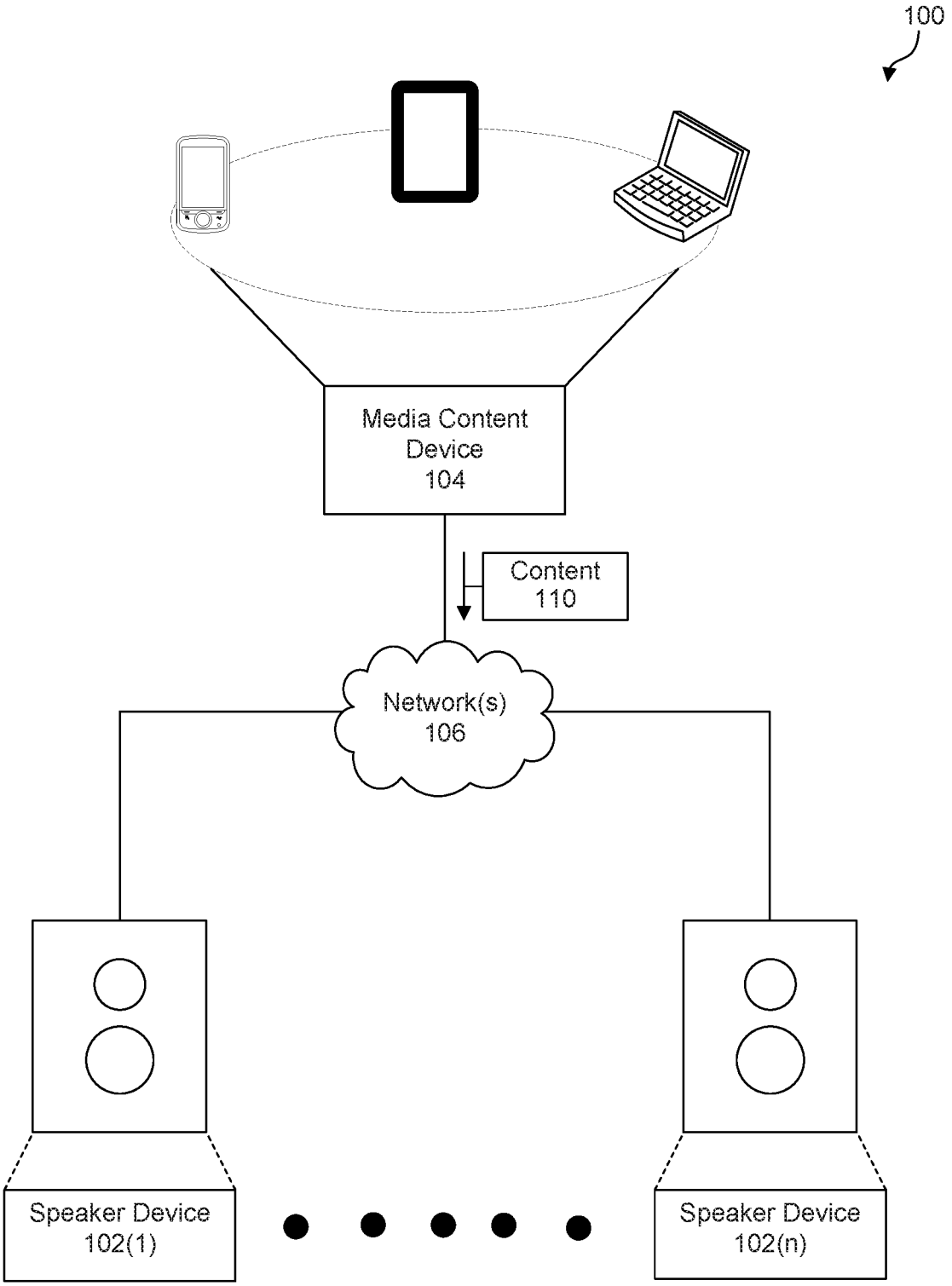
FIG. 1 illustrates an entertainment system with a plurality of speakers, according to some embodiments.

Provided herein are system, apparatus, article of manufacture, method and/or computer program product embodiments, and/or combinations and sub-combinations thereof, for low frequencies of an output signal.

In some embodiments, the present disclosure is directed to a method for low frequencies of an output signal. The method may include: measuring a sound pressure level (SPL) of a speaker or a voltage level applied to the speaker; dynamically selecting, based on the measured SPL or the measured voltage level, a cutoff frequency for operating a first filter configured to provide a first bass component of a bass element of an output signal and a second filter configured to provide a second bass component of the bass element; providing the cutoff frequency to the first filter to configure the first filter to generate the first bass component based on the cutoff frequency; providing the cutoff frequency to the second filter to configure the second filter to generate the second bass component based on the cutoff frequency; and generating an output signal based on at least one of the first and second bass components.

In some embodiments, the present disclosure is directed to a device. The device may include a first circuit having: an excursion predictor configured to predict an excursion of a speaker based on a measured sound pressure level (SPL) of the speaker or a measured voltage level applied to the speaker; a cutoff frequency selector configured to dynamically select a cutoff frequency based on the predicted excursion; and a first filter configured to operate based on the cutoff frequency, wherein the first circuit is configured to provide a first bass component of a bass element of an output signal. The device may also include a second circuit having: a second filter configured to operate based on the cutoff frequency; and a non-linear processing unit configured to generate harmonics of an input signal, wherein the second circuit is configured to provide a second bass component of the bass element. The device may also include a mixer configured to generate the output signal based on at least one of the first and second bass components.

In some embodiments, the present disclosure is directed to a non-transitory, tangible computer-readable device having instructions stored thereon that, when executed by at least one computing device, causes the at least one computing device to perform operations. The operations may include: measuring a sound pressure level (SPL) of a speaker or a voltage level applied to the speaker; dynamically selecting, based on the measured SPL or the measured voltage level, a cutoff frequency for operating a first filter configured to provide a first bass component of a bass element of an output signal and a second filter configured to provide a second bass component of the bass element; providing the cutoff frequency to the first filter to configure the first filter to generate the first bass component based on the cutoff frequency; providing the cutoff frequency to the second filter to configure the second filter to generate the second bass component based on the cutoff frequency; and generating an output signal based on at least one of the first and second bass components.

Further features and advantages of the embodiments disclosed herein, as well as the structure and operation of various embodiments, are described in details below with reference to the accompanying drawings. It is noted that this disclosure is not limited to the specific embodiments described herein. Such embodiments are presented herein for illustrative purposes only. Additional embodiments will be apparent to a person skilled in the relevant art based on the teachings contained herein.

DETAILED DESCRIPTION OF THE INVENTION

Provided herein are system, method, computer program product and/or device embodiments, and/or combinations thereof, to managing low frequencies of an output signal.

FIG. 1 illustrates an entertainment system for providing audio content via a plurality of heterogeneous speakers. Referring to FIG. 1, an entertainment system 100 may include a plurality of speakers 102, e.g., speakers 102(1)-102(*n*), collectively referred to as speakers 102, placed in any location and/or configuration within a listening environment, and a media content device 104. Each speaker 102 may be wired or wireless. Although FIG. 1 illustrates two speakers 102, the entertainment system 100 may include any number of speakers 102, as should be understood by those of ordinary skill in the art.

The media content device 104 may be, without limitation, a media player, television, a wireless device, a smartphone, a tablet computer, a laptop/mobile computer, a handheld computer, a server computer, an in-appliance device, Internet of Things (IoT) device, streaming media player, a game console, and/or an audio/video receiver. In some embodiments, the media content device 104 may be located in the same listening environment as the plurality of speakers 102. Additionally, or alternatively, the media content device 104 may be located remotely from the speakers 102. The speakers 102 and the content device 104 may communicate via a communication network(s) 106. The communication network 106 may include any or all of a wired and/or wireless private network, personal area network (PAN), Local-Area Network (LAN), a Wide-Area Network (WAN), or the Internet. In some embodiments, media content 110 may be stored on the media content device 104 and transmitted to each of the speakers 102, such that the speakers 102 synchronously reproduce the media content 110.

In some embodiments, the speakers 102 may be different types of audio devices. For example, the speakers 102 may be, without limitation, a combination of one or more different types of speakers, such as full-range drivers, subwoofers, woofers, mid-range drivers, tweeters, sound bars, and/or coaxial drivers, to name just some examples. It should be understood by those of ordinary skill in the arts that each of the speakers 102 may be designed to produce sound at different frequencies. For example, a tweeter may be designed to produce sound at high audio frequencies, e.g., 2,000 Hz to 20,000 Hz, whereas subwoofers and woofers may be designed to produce sound at low audio frequencies, e.g., 40 Hz up to 500 Hz. As such, each speaker 102 may be designed to produce different features of an audio signal, e.g., tweeters may be designed to produce more treble, whereas woofers and subwoofers may be designed to produce more bass and sub-bass, respectively.

Figure 2:
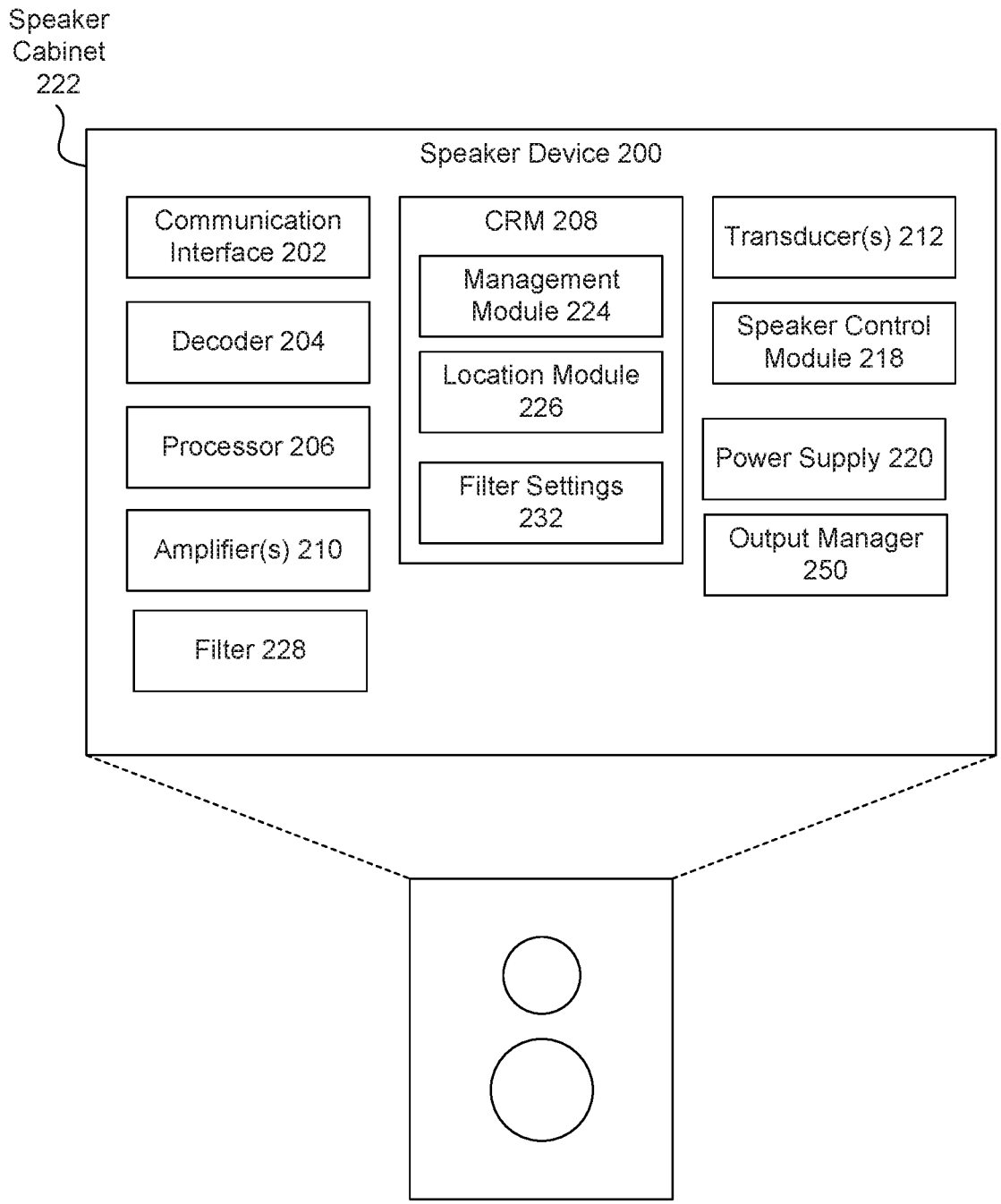
FIG. 2 illustrates a speaker, according to some embodiments.

FIG. 2 is a block diagram of an example embodiment of a speaker 200, e.g., the speakers 102 of FIG. 1. The speaker 200 may comprise one or more communication interfaces 202 for receiving content (e.g., the media content 110 of FIG. 1) from a content device (e.g., the media content device 104 of FIG. 1), a decoder 204 for decoding the media content into its separate audio components, a processor 206, a speaker control module 218 for receiving user commands via one or more controls (e.g., buttons and/or a remote control interface), a power supply 220, or more filters 228 (e.g., the filters 120), an output manager 250, and a speaker cabinet 222 to enclose components of the speaker 200.

The communication interface(s) 202 may include one or more interfaces and hardware components for enabling communication with various other devices. For example, communication interface(s) 202 facilitate communication through one or more of the Internet, cellular networks, and wireless networks (e.g., Wi-Fi, cellular). The non-transitory, tangible computer readable memory (CRM) 208 may be used to store any number of functional components that are executable by the processor 206. In many implementations, these functional components comprise instructions or programs that are executable by the processors and that, when executed, specifically configure the one or more processors 206 to perform the actions attributed above to the speakers (e.g., the speakers 102). In addition, the non-transitory, tangible computer readable memory 208 stores data used for performing the operations described herein. In the illustrated example, the functional components stored in the non-transitory computer readable memory 208 include a management module 224, and a location module 226. In some embodiments, the location module 226 may include a global positioning system (GPS) and/or an indoor positioning system (IPS) device. Further, the non-transitory computer readable memory 208 may store state information and filter settings 232 corresponding to the speaker 200.

The processor 206 may select which portion of the content will be processed. In some embodiments, in a stereo mode, for example, the speaker 200 processes either the left stereophonic channel or right stereophonic channel. In a surround sound mode, the speaker 200 selects a signal to process from among the multiple channels. The selection of the playback mode (e.g., stereo mode, mono mode, surround sound mode) may be performed via the speaker control module 218. In some embodiments, the filters 228 modify the content to determine the frequencies of the content that are reproduced by the speaker 200 in accordance with the filter settings 232. This may be done by performing crossover, phase matching, and time alignment filtering function in a digital implementation. In some examples, the filters 228 may include FIR or IIR filters that implement a crossover filtering technique.

The output of the processor 206 may be a set of filtered digital audio signals, one for each of the transducers 212. These signals may be directed to the inputs of digital amplifiers, which generate high power output signals that drive the speaker transducers 212 to produce an optimal and/or improved reproduction of the content in concert with one or more other speakers having different performance capabilities in accordance with the present invention.

Figure 3:
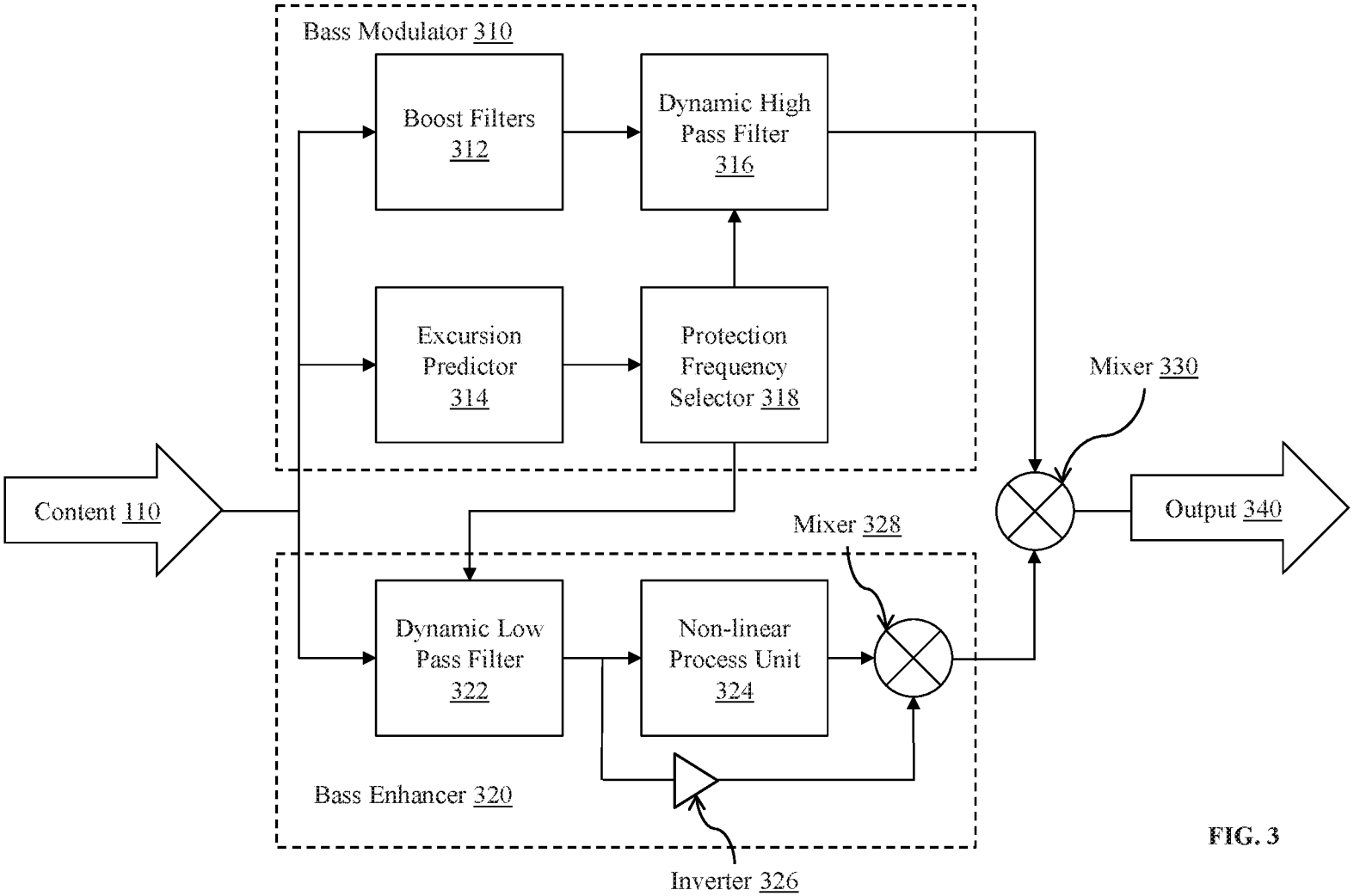
FIG. 3 illustrates an output manager, according to some embodiments.

FIG. 3 illustrates a schematic diagram of an output manager, e.g., output manager 250 of FIG. 2. In some embodiments, the output manager 250 may include a bass modulator 310, a bass enhancer 320, and a first mixer 330. The bass modulator 310 may include one or more boost filters 312, an excursion predictor 314, a dynamic high pass filter 316, and a frequency protection selector 318. And the bass enhancer 320 may include a dynamic low pass filter, a non-linear processing unit 324, an inverter 326, and a second mixer 328.

In some embodiments, the output manager 250 may receive an input signal having content, e.g., media content 110, from, for example, the media content device 104. In operation, the output manager 250 may be configured to balance between generating a bass element of the media content 110 using the bass modulator 310 and the bass enhancer 320. To achieve this, the media content 110 may be provided to both the bass modulator 310 and the bass enhancer 320, and the bass modulator 310 and the bass enhancer 320 may process the media content 110 to generate an output 340 having a bass based on contributions from both the bass modulator 310 and the bass enhancer 320. For example, an output of the bass modulator 310 and an output of the bass enhancer 320 may be combined using the first mixer 330 to generate the output 340 to be output by the speaker, e.g., speaker 102 of FIG. 2.

In some embodiments, the output manager 250 may be configured to analyze the media content 110 and a sound pressure level (SPL) of the speaker (or a voltage level) and determine whether the bass element may be generated using a first bass component (e.g., a fundamental), a second bass component (e.g., a psychoacoustic harmonic), or a combination of both. For example, the first bass component may be generated based on a low-frequency excursion of the speaker 102 using the bass modulator 310 and the second bass component may be based on psychoacoustic harmonics using the bass enhancer 320. For example, the output manager 250 may generate the bass element of the media content 110 using the bass modulator 310 when the speaker 102 is operating below a first SPL threshold, e.g., 25% of a maximum SPL.

As the SPL or voltage level increases, the output manager 250 may transition to generating the bass element based on a combination of the bass modulator 310 and the bass enhancer 320. For example, when the speaker 120 is operating between the first SPL threshold and a second SPL threshold, e.g., between 25% and 75% of the maximum SPL, the output manager 250 may generate the bass element using the combination of the bass modulator 310 and the bass enhancer 320. That is, when the SPL is between the first SPL and the SPL, the bass modulator 310 and bass enhancer 320 may operate in tandem with one another to generate the bass element.

As the SPL (or voltage level) increases even further, the output manager 250 may transition to generating the bass element using the bass enhancer 320. For example, when the speaker 120 is operating above the second SPL threshold, e.g., above 75% of the maximum SPL, the output manager 250 may generate the bass using the bass enhancer 320. It should be understood by those of ordinary skill in the art that these are example SPL thresholds for balancing the bass generation between the bass modulator 310 and the bass enhancer 320, and that other SPLs are further contemplated in accordance with aspects of the present disclosure.

In some embodiments, the output manager 250 may generate the bass element of the media content 110 using the bass modulator 310 or the bass enhancer 320 based on a voltage threshold and a protection frequency. For example, the threshold voltage may be determined by mapping a root means square (rms) level of the measured voltage signal to a frequency. For example, this may be achieved using equation (1):

$$\text{frequency}=\text{max_frequency}*\text{sqrt}(\text{rms}/\text{max_rms}) \quad (1).$$

In some embodiments, the frequency calculated using equation (1) may then be used as a protection frequency of a mechanical protection filter of the speaker 102, as should be understood by those of ordinary skill in the art. In some embodiments, the output manager 250 may generate the bass element of the media content 110 using the bass modulator 310 at frequencies above the protection frequency and using the bass enhancer 320 for frequencies below the protection frequency. For example, for a max_rms equal to 1.0, a max_frequency equal to 190 Hz, and a max sine wave would yield an RMS of 0.7 and a protection frequency of 159 Hz. In this example, the output manager 250 may generate the bass element of the media content 110 using the bass modulator 310 at frequencies above 159 Hz and using the bass enhancer 320 for frequencies below 159 Hz. It should be understood by those of ordinary skill in the arts that this value changes may be changing multiple times per second based on the media content 110. In some embodiments, the rms and max_rms may be normalized voltage signals having a value between 0 and 1. In some embodiments, these values may be based on the capabilities of the speaker 102, such as, but not limited to, driver sensitivity, driver excursion, acoustic air volume, or the like.

In some embodiments, the media content 110 may be provided to each of the bass modulator 310 and the bass enhancer 320. In particular, as shown in FIG. 3, the media content 110 may be provided to the boost filter(s) 312 and the excursion predictor 314. In some embodiments, the boost filter(s) 312 may be configured to boost (or attenuate) one or more frequencies of the media content 110. An output of the boost filter(s) 312 may be provided to the dynamic high pass filter 316 as a first input. The media content 110 may also be provided to the excursion predictor 314, which may monitor the SPL of the speaker 102 (or the voltage level) and predict an excursion of the speaker 102. In some embodiments, the predicted excursion may be made on a sample by sample basis. The predicted excursion may be provided as an input to the frequency protection selector 318.

Using the predicted excursion, the frequency protection selector 318 may select a frequency, e.g., a cutoff frequency, for operating the dynamic high pass filter 316 and the dynamic low pass filter 322. The cutoff frequency may be provided as an input to the dynamic high pass filter 316 and the dynamic low pass filter 322. By providing the cutoff frequency to both the dynamic high pass filter 316 and the dynamic low pass filter 322, the cutoff frequency may be used to control whether the bass element is generated using the bass modulator 310, the bass enhancer 320, or the combination of both. The cutoff frequency may be a frequency at which a level of excursion of the speaker 102 may cause distortions in the output 340 or may cause damage to the speaker 102.

For example, using the cutoff frequency, the dynamic high pass filter 316 may be adjusted on a sample by sample basis to protect the speaker 102 from excursions that would damage the speaker 102. In some embodiments, the dynamic high pass filter 316 may pass signals of the output from the booster filter(s) 312 with a frequency higher than the cutoff frequency while attenuating signals with frequencies lower than the cutoff frequency, as should be understood by those of ordinary skill in the art. In some embodiments, the dynamic high pass filter 322 may be a second order filter and a relationship between the excursion and the SPL may likewise be a second order relationship, and as such, the dynamic high pass filter 322 may be configured to maximize the amount of excursion of the speaker 102 without causing any damage thereto. In this way, the bass modulator 310 may adjust the amount of the first bass component being generated on a sample by sample basis.

Additionally, using the cutoff frequency, the dynamic low pass filter 322 may likewise be adjusted on a sample by sample basis. For example, the dynamic low pass filter 322 may pass signals with a frequency lower than the cutoff frequency while attenuating signals with frequencies higher than the cutoff frequency, as should be understood by those of ordinary skill in the art. In this way, the dynamic low pass filter 322 functions as the inverse of the dynamic high pass filter 316. By providing the cutoff frequency to both of the dynamic high pass filter 316 and the dynamic low pass filter 322, these filters may be linked to one another, such that as the mechanical capabilities of the speaker 102 limit the amount of the first bass component generated by the bass modulator 310, the bass enhancer 320 increases the amount of the second bass component.

In some embodiments, an output of the dynamic low pass filter 322 may be provided to the non-linear processing unit 324 and the inverter 326. In some embodiments, the non-linear processing unit 324 may be configured to generate the second bass component, i.e., the psychoacoustic harmonics, of the media content 110, as should be understood by those of ordinary skill in the arts. In some embodiments, the inverter 326 may be configured to invert the output of the dynamic low pass filter 322, such that when an output of the inverter 326 is combined with an output of the non-linear processing unit 324, the second mixer 328 eliminates any of the first bass component that may exist on the output of the non-linear processing unit 324.

An output of each of the bass modulator 310 and the bass enhancer 320 may be combined using, for example, the first mixer 330, which may then generate the output 340. For example, the output of the bass modulator may be an output of the dynamic high pass filter 316 and the output of the second mixer 328 may be provided as inputs to the first mixer 330.

Figure 4:
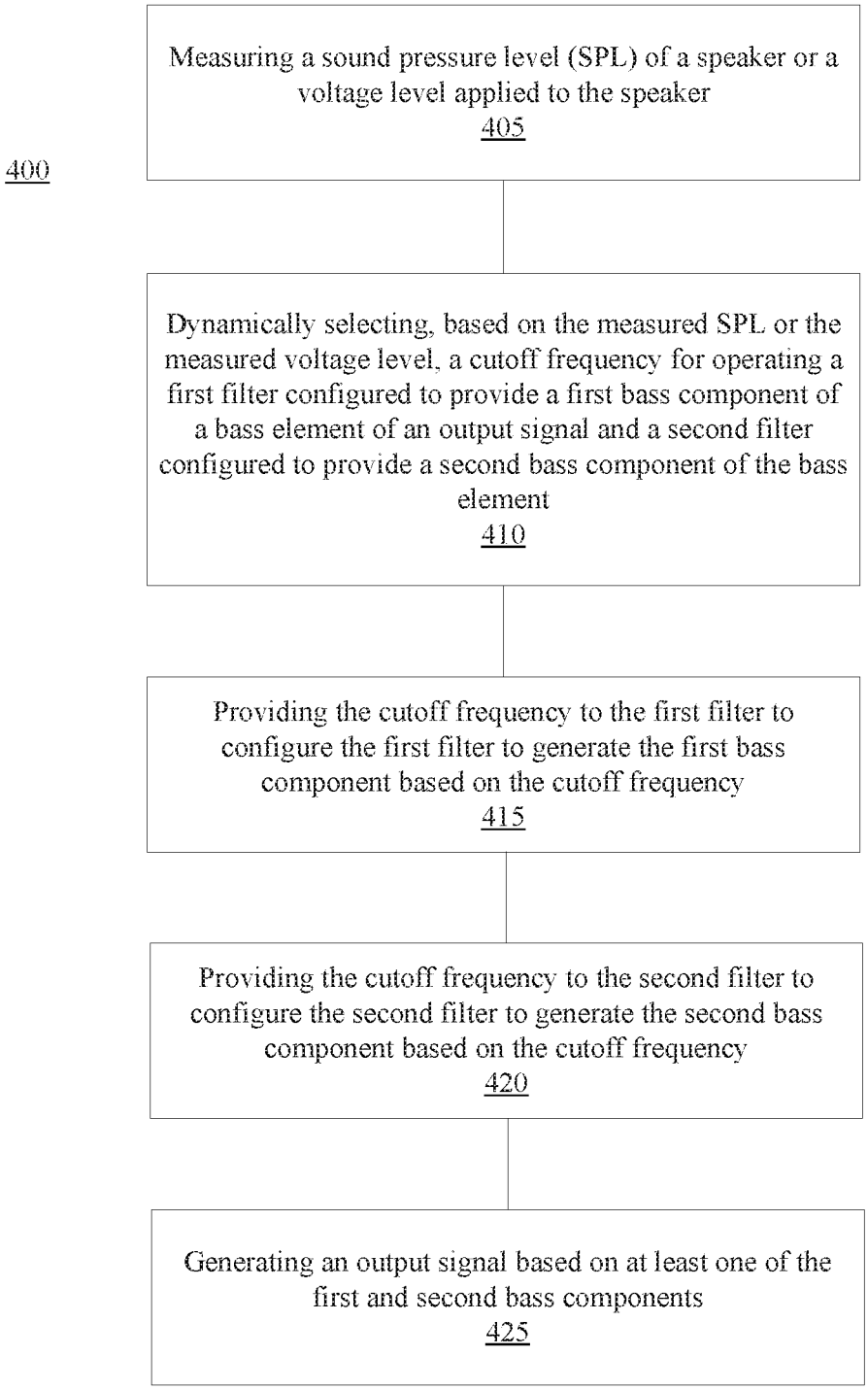
FIG. 4 illustrates a flowchart for managing low frequencies of an output signal, according to some embodiments.

FIG. 4 illustrates an example method for managing low frequencies of an output signal.

For example, at 405, an excursion predictor (e.g., excursion predictor 314 of FIG. 3) may measure a sound pressure level (SPL) of a speaker or a voltage level applied to the speaker.

At 410, a frequency protection selector (e.g., the frequency protection selector 318 of FIG. 3), may dynamically selecting, based on the measured SPL or the measured voltage level, a cutoff frequency for operating a first filter (e.g., the high pass filter 316 of FIG. 3 or the low pass filter 322 of FIG. 3) configured to provide a first bass component of a bass element of an output signal, and a second filter (e.g., the high pass filter 316 of FIG. 3 or the low pass filter 322 of FIG. 3) configured to provide a second bass component of the bass element.

At 415, the frequency protection selector (e.g., the frequency protection selector 318 of FIG. 3) may provide the cutoff frequency to the first filter (e.g., the high pass filter 316 of FIG. 3 or the low pass filter 322 of FIG. 3) to configure the first filter (e.g., the high pass filter 316 of FIG. 3 or the low pass filter 322 of FIG. 3) to generate the first bass component based on the cutoff frequency.

At 420, the frequency protection selector (e.g., the frequency protection selector 318 of FIG. 3) may provide the cutoff frequency to the second filter (e.g., the high pass filter 316 of FIG. 3 or the low pass filter 322 of FIG. 3) to configure the second filter (e.g., the high pass filter 316 of FIG. 3 or the low pass filter 322 of FIG. 3) to generate the second bass component based on the cutoff frequency.

At 425, a mixer (e.g., the first mixer 330 of FIG. 3) may generate an output signal based on at least one of the first and second bass components.

It will be appreciated by those skilled in the art that the functionality of the speakers described herein may be performed by other entertainment devices, such as a media player, television, a wireless device, a smartphone, a tablet computer, a laptop/mobile computer, a handheld computer, a server computer, an in-appliance device, streaming media player, a game console, an audio/video receiver, and so forth.

Example Computer System

Figure 5:
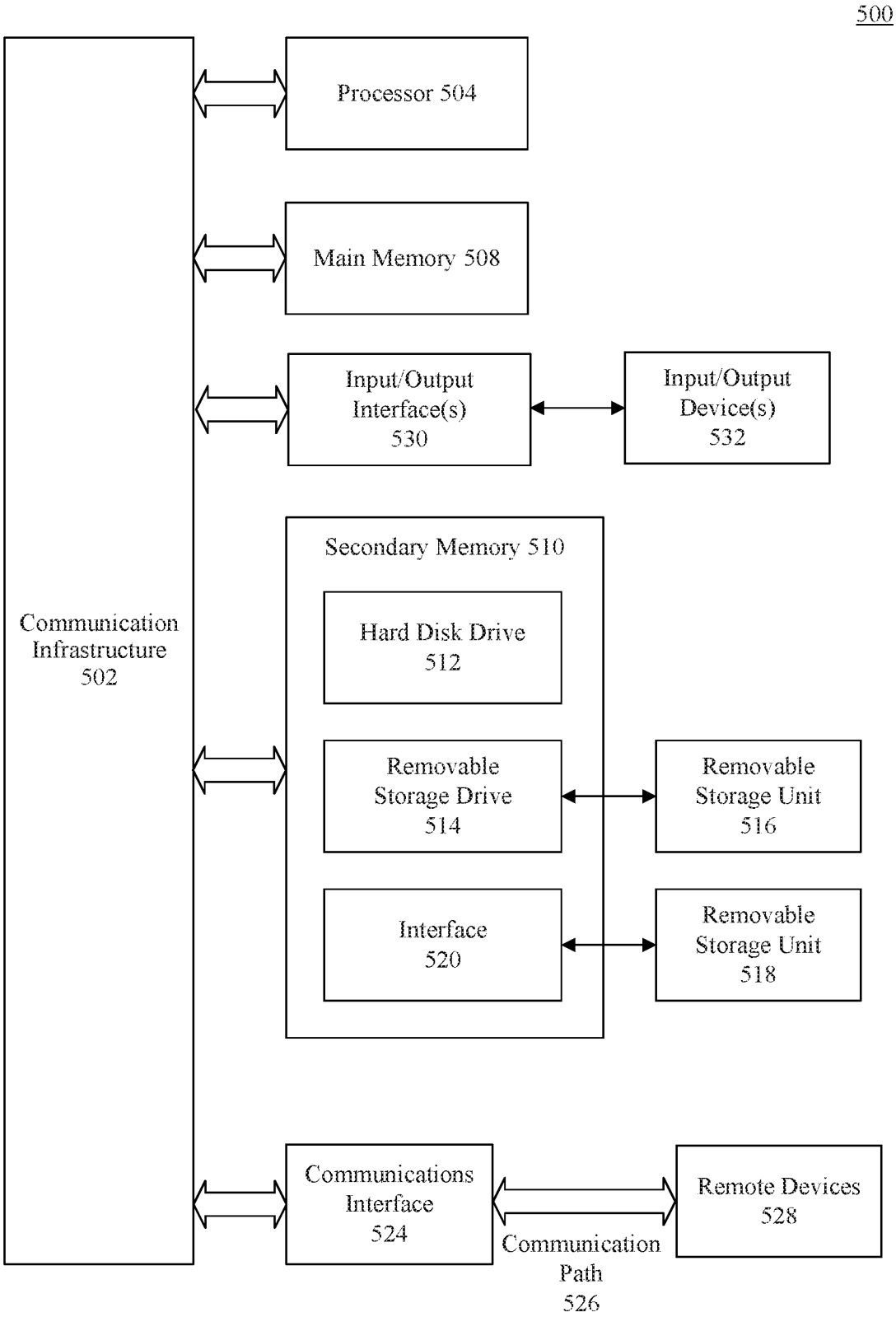
FIG. 5 illustrates an example computer system useful for implementing various embodiments.

Various embodiments can be implemented, for example, using one or more well-known computer systems, such as computer system 500 shown in FIG. 5. Computer system 500 can be any well-known computer capable of performing the functions described herein, such as computers available from International Business Machines, Apple, Sun, HP, Dell, Sony, Toshiba, etc.

Computer system 500 includes one or more processors (also called central processing units, or CPUs), such as a processor 504. Processor 504 is connected to a communication infrastructure or bus 502.

Computer system 500 also includes user input/output device(s) 532, such as monitors, keyboards, pointing devices, etc., which communicate with communication infrastructure 502 through user input/output interface(s) 530.

Computer system 500 also includes a main or primary memory 508, such as random access memory (RAM). Main memory 508 may include one or more levels of cache. Main memory 508 has stored therein control logic (i.e., computer software) and/or data.

Computer system 500 may also include one or more secondary storage devices or memory 510. Secondary memory 510 may include, for example, a hard disk drive 512 and/or a removable storage device or drive 514. Removable storage drive 514 may be a floppy disk drive, a magnetic tape drive, a compact disk drive, an optical storage device, tape backup device, and/or any other storage device/drive.

Removable storage drive 514 and interface 520 may interact with a removable storage units 516, 518, respectively. Removable storage units 516, 518 includes a computer usable or readable storage device having stored thereon computer software (control logic) and/or data. Removable storage units 516, 518 may be a floppy disk, magnetic tape, compact disk, DVD, optical storage disk, and/ any other computer data storage device. Removable storage drive 514 reads from and/or writes to removable storage unit 516 in a well-known manner.

According to an exemplary embodiment, secondary memory 510 may include other means, instrumentalities or other approaches for allowing computer programs and/or other instructions and/or data to be accessed by computer system 500. Such means, instrumentalities or other approaches may include, for example, a removable storage drive 514 and an interface 520. Examples of the removable storage drive 514 and the interface 520 may include a program cartridge and cartridge interface (such as that found in video game devices), a removable memory chip (such as an EPROM or PROM) and associated socket, a memory stick and USB port, a memory card and associated memory card slot, and/or any other removable storage unit and associated interface.

Computer system 500 may further include a communication or network interface 524. Communication interface 524 enables computer system 500 to communicate and interact with any combination of remote devices, remote networks, remote entities, etc. (individually and collectively referenced by reference number 528). For example, communication interface 524 may allow computer system 500 to communicate with remote devices 528 over communications path 526, which may be wired and/or wireless, and which may include any combination of LANs, WANs, the Internet, etc. Control logic and/or data may be transmitted to and from computer system 500 via communication path 526.

In an embodiment, a tangible apparatus or article of manufacture comprising a tangible computer useable or readable medium having control logic (software) stored thereon is also referred to herein as a computer program product or program storage device. This includes, but is not limited to, computer system 500, main memory 508, secondary memory 510, and removable storage units 516, 518, as well as tangible articles of manufacture embodying any combination of the foregoing. Such control logic, when executed by one or more data processing devices (such as computer system 500), causes such data processing devices to operate as described herein.

Based on the teachings contained in this disclosure, it will be apparent to persons skilled in the relevant art(s) how to make and use embodiments of this disclosure using data processing devices, computer systems and/or computer architectures other than that shown in FIG. 5. In particular, embodiments can operate with software, hardware, and/or operating system implementations other than those described herein.

It is to be appreciated that the Detailed Description section, and not any other section, is intended to be used to interpret the claims. Other sections can set forth one or more but not all exemplary embodiments as contemplated by the inventor(s), and thus, are not intended to limit this disclosure or the appended claims in any way.

While this disclosure describes exemplary embodiments for exemplary fields and applications, it should be understood that the disclosure is not limited thereto. Other embodiments and modifications thereto are possible, and are within the scope and spirit of this disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments can perform functional blocks, steps, operations, methods, etc. using orderings different than those described herein.

References herein to "one embodiment," "an embodiment," "an example embodiment," or similar phrases, indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein. Additionally, some embodiments can be described using the expression "coupled" and "connected" along with their derivatives. These terms are not necessarily intended as synonyms for each other. For example, some embodiments can be described using the terms "connected" and/or "coupled" to indicate that two or more elements are in direct physical or electrical contact with each other. The term "coupled," however, can also mean that two or more elements are not in direct contact with each other, but yet still co-operate or interact with each other.

The breadth and scope of this disclosure should not be limited by any of the above-described exemplary embodiments, but should be defined only in accordance with the following claims and their equivalents.

What is claimed is:

1. A method comprising:

measuring a sound pressure level (SPL) of a speaker or a voltage level applied to the speaker;

dynamically selecting, based on the measured SPL or the measured voltage level, a cutoff frequency for operating a first filter configured to provide a first bass component of a bass element of an output signal and a second filter configured to provide a second bass component of the bass element;

providing the cutoff frequency to the first filter to configure the first filter to generate the first bass component based on the cutoff frequency;

providing the cutoff frequency to the second filter to configure the second filter to generate the second bass component based on the cutoff frequency; and generating an output signal based on at least one of the first or second bass components, wherein:

when the measured SPL is below a first threshold level, generating the output signal comprises generating the output signal based on the first bass component without the second bass component;

when the measured SPL is between the first threshold level and a second threshold level, generating the output signal comprises generating the output signal based on a combination of the first bass component and the second bass component; and when the measured SPL is above the second threshold level, generating the output signal comprises generating the output signal based on the second bass component without the first bass component.

2. The method of claim 1, further comprising generating a predicted excursion of the speaker based on the measured SPL or the measured voltage level voltage and a frequency of an input signal.

3. The method of claim 2, wherein the cutoff frequency is based on the predicted excursion.

4. The method of claim 2, wherein generating the predicted excursion comprises generating the predicted excursion on a sample by sample basis of the input signal.

5. The method of claim 1, further comprising mapping a root means square level of the measured voltage signal to a frequency to determine a protection frequency.

6. The method of claim 5, wherein generating the output signal comprises generating the output signal based on the first bass component at frequencies above the protection frequency and based on the second component at frequencies below the protection frequency.

7. A device comprising:

a first circuit comprising:

an excursion predictor configured to predict an excursion of a speaker based on a measured sound pressure level (SPL) of the speaker or a measured voltage level applied to the speaker;

a cutoff frequency selector configured to dynamically select a cutoff frequency based on the predicted excursion; and a first filter configured to operate based on the cutoff frequency, wherein the first circuit is configured to provide a first bass component of a bass element of an output signal;

a second circuit comprising:

a second filter configured to operate based on the cutoff frequency; and a non-linear processing unit configured to generate harmonics of an input signal, wherein the second circuit is configured to provide a second bass component of the bass element; and a mixer configured to generate the output signal based on at least one of the first or second bass components, wherein the mixer is configured to:

generate the output signal based on the first bass component without the second bass component when the measured SPL is below a first threshold level;

generate the output signal based on a combination of the first bass component and the second bass component when the measured SPL is between the first threshold level and a second threshold level; and generate the output signal based on the second bass component without the first bass component when the measured SPL is above the second threshold level.

8. The device of claim 7, wherein the first filter comprises a dynamic high pass filter.

9. The device of claim 7, wherein the second filter comprises a dynamic low pass filter.

10. The device of claim 7, wherein the predicted excursion is generated on a sample by sample basis of the input signal.

11. The device of claim 7, further comprising a processor configured to map a root means square level of the measured voltage signal to a frequency to determine a protection frequency.

12. The device of claim 11, wherein the mixer is configured to generate the output signal based on the first bass component at frequencies above the protection frequency and based on the second component at frequencies below the protection frequency.

13. A non-transitory, tangible computer-readable medium having instructions stored thereon that, when executed by at least one computing device, cause the at least one computing device to perform operations comprising:

measuring a sound pressure level (SPL) of a speaker or a voltage level applied to the speaker;

dynamically selecting, based on the measured SPL or the measured voltage level, a cutoff frequency for operating a first filter configured to provide a first bass component of a bass element of an output signal and a second filter configured to provide a second bass component of the bass element;

providing the cutoff frequency to the first filter to configure the first filter to generate the first bass component based on the cutoff frequency;

providing the cutoff frequency to the second filter to configure the second filter to generate the second bass component based on the cutoff frequency; and generating an output signal based on at least one of the first or second bass components, wherein:

when the measured SPL is below a first threshold level, generating the output signal comprises generating the output signal based on the first bass component without the second bass component;

when the measured SPL is between the first threshold level and a second threshold level, generating the output signal comprises generating the output signal based on a combination of the first bass component and the second bass component; and when the measured SPL is above the second threshold level, generating the output signal comprises generating the output signal based on the second bass component without the first bass component.

14. The non-transitory, tangible computer-readable medium of claim 13, the operations further comprising generating a predicted excursion of the speaker based on the measured SPL or the measured voltage level and a frequency of an input signal, wherein the cutoff frequency is based on the predicted excursion.

15. The non-transitory, tangible computer-readable medium of claim 14, wherein generating the predicted excursion comprises generating the predicted excursion on a sample by sample basis of the input signal.

16. The non-transitory, tangible computer-readable medium of claim 13, the operations further comprising mapping a root means square level of the measured voltage signal to a frequency to determine a protection frequency.

17. The non-transitory, tangible computer-readable medium of claim 16, wherein generating the output signal comprises generating the output signal based on the first bass component at frequencies above the protection frequency and based on the second component at frequencies below the protection frequency.

18. The method of claim 1, wherein the cutoff frequency is provided to the first filter and the second filter in parallel.

19. The device of claim 7, wherein the cutoff frequency is provided to the first filter and the second filter in parallel.

20. The non-transitory, tangible computer-readable medium of claim 13, wherein the cutoff frequency is provided to the first filter and the second filter in parallel.

* * * * *